US005125119A

United States Patent [19]

Munoz

[11] Patent Number: 5,125,119

[45] Date of Patent: Jun. 30, 1992

[54] ODOR REDUCTION TOILET APPARATUS

[76] Inventor: Jesus Munoz, 967 NE. 78 St., Miami, Fla. 33138

[21] Appl. No.: 628,400

[22] Filed: Dec. 17, 1990

Related U.S. Application Data

[63] Continuation-in-part of Ser. No. 494,437, Apr. 19, 1990, abandoned.

[51] Int. Cl.[5] ..... E03D 9/03; E03D 9/052

[52] U.S. Cl. ..... 4/213; 4/225.1; 4/228.1

[58] Field of Search ..... 4/213, 223, 224, 225, 4/228

[56] References Cited

U.S. PATENT DOCUMENTS

| | | | |
|---|---|---|---|
| 669,572 | 3/1901 | Blackmore | 4/225 |
| 1,342,716 | 6/1920 | Johnston | 4/213 |
| 1,419,498 | 6/1922 | Grant | 4/225 |
| 2,279,789 | 4/1942 | Jentzer | 4/213 |
| 2,761,151 | 9/1956 | Ferrcindo | 4/225 |
| 3,105,245 | 10/1963 | Finkbiner | 4/228 |
| 3,230,551 | 1/1966 | Kopp | 4/213 |
| 3,290,698 | 12/1966 | Joyner et al. | 4/228 |
| 3,444,566 | 5/1969 | Spear | 4/228 |
| 4,031,574 | 6/1977 | Werner | 4/213 |

FOREIGN PATENT DOCUMENTS

| | | | |
|---|---|---|---|
| 908352 | 8/1972 | Canada | 4/213 |
| 919354 | 1/1973 | Canada | 4/213 |
| 16646 | of 1898 | United Kingdom | 4/225 |
| 493200 | 10/1938 | United Kingdom | 4/213 |

*Primary Examiner*—Henry J. Recla
*Assistant Examiner*—Robert M. Fetsuga
*Attorney, Agent, or Firm*—Alfred M. Walker

[57] ABSTRACT

An odor reducing toilet which includes a system for incremental discharge, release and circulation of small quantites of deodorant within the air and water from the toilet bowl. The present invention relates to an odor reduction toilet apparatus for which is particularly usable in reducing air and water generated odors from liquid waste and solid waste. These odors are reduced by incrementally introducing deodorant substances into the water during a toilet flush, as well as by moving odor filled air away from the toilet bowl in an isolated and efficient manner through the overflow drain for dispersal.

6 Claims, 8 Drawing Sheets

5
4
7
6
3B
3A
8
1
31
32
33
2

Fig. 2
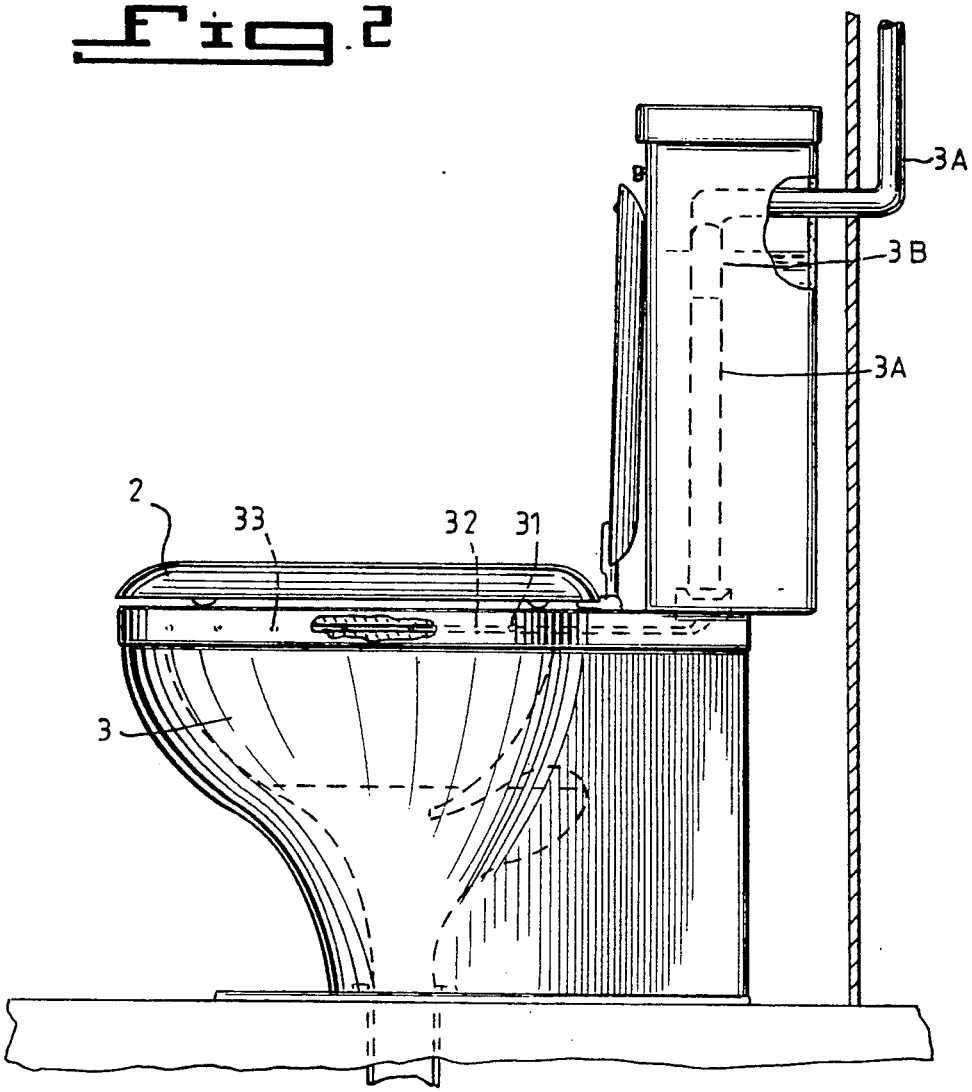
Fig. 3
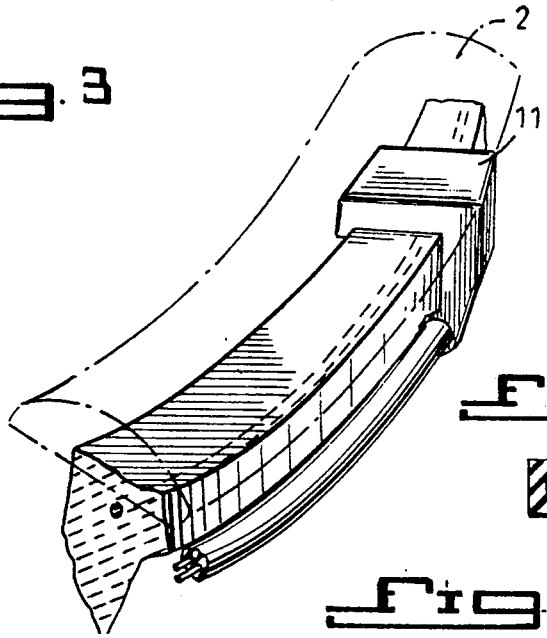
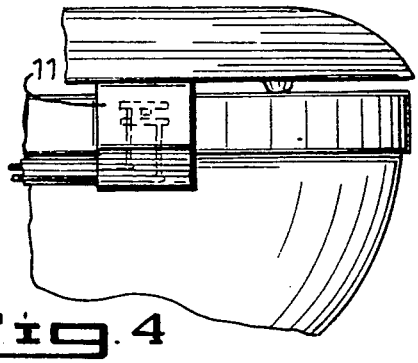
Fig. 4
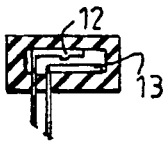
Fig. 5
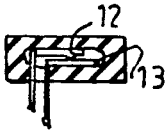
Fig. 6

Fig. 11
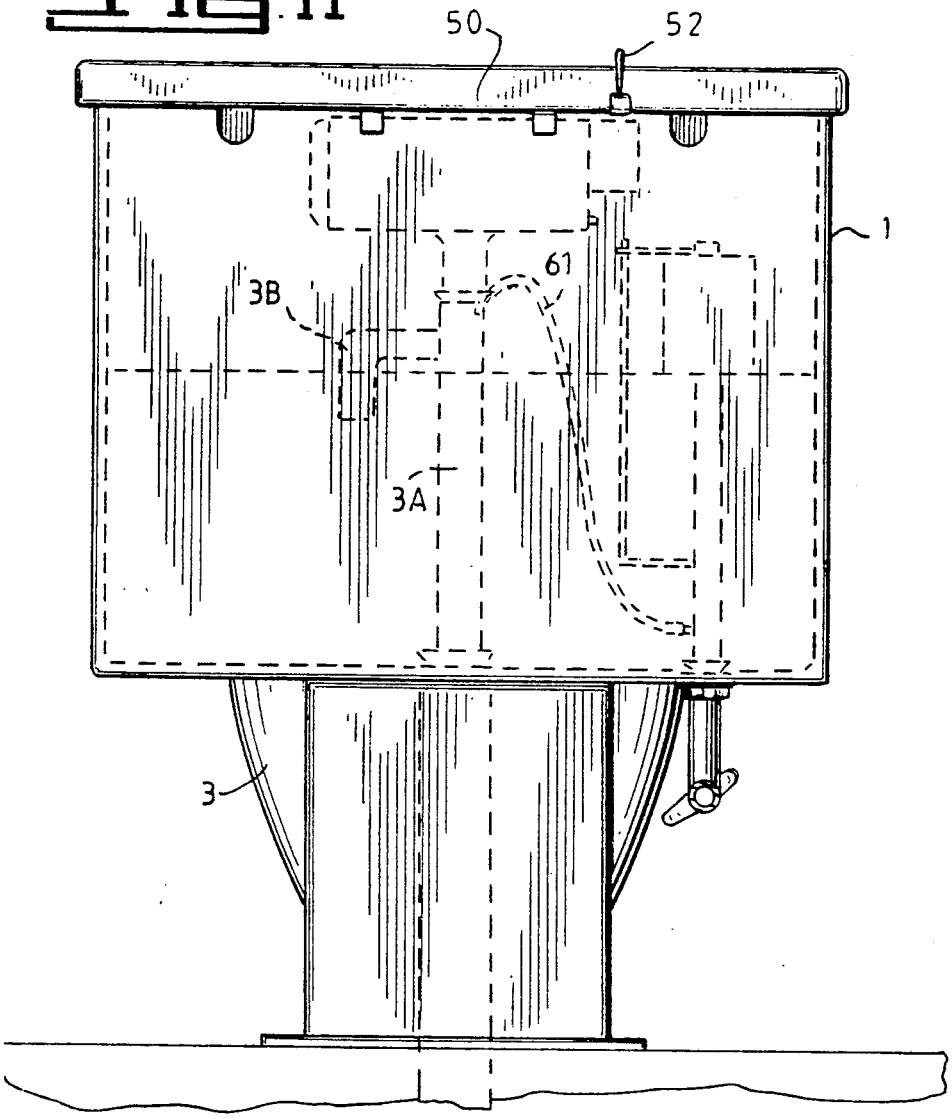
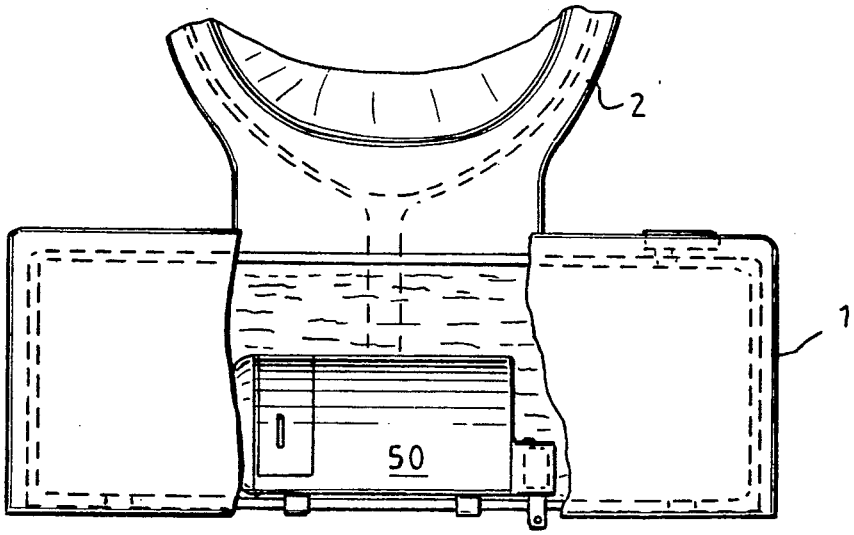
Fig. 12

52
91
60
64
74
75
72
76
3A
62

56
46
52

Fig. 16
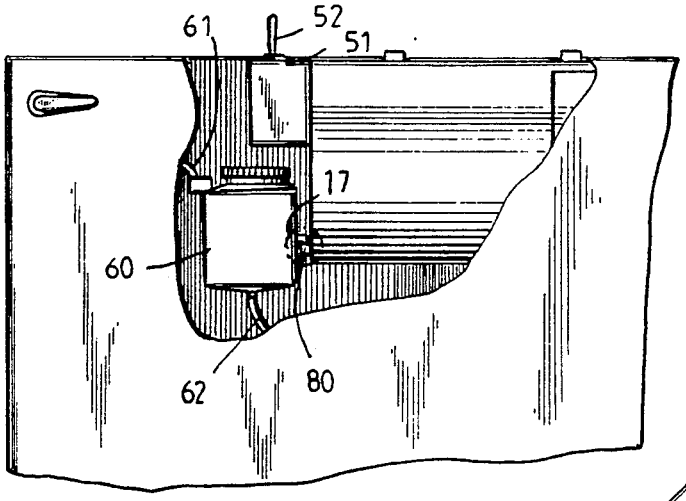
Fig. 17
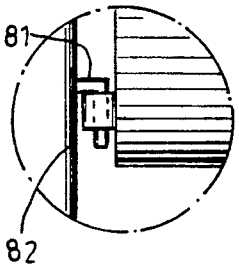
Fig. 19
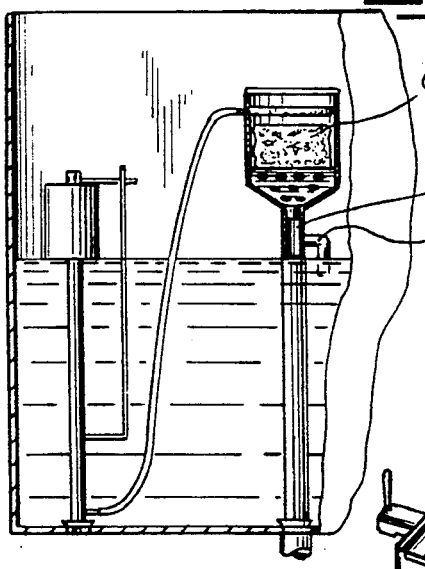
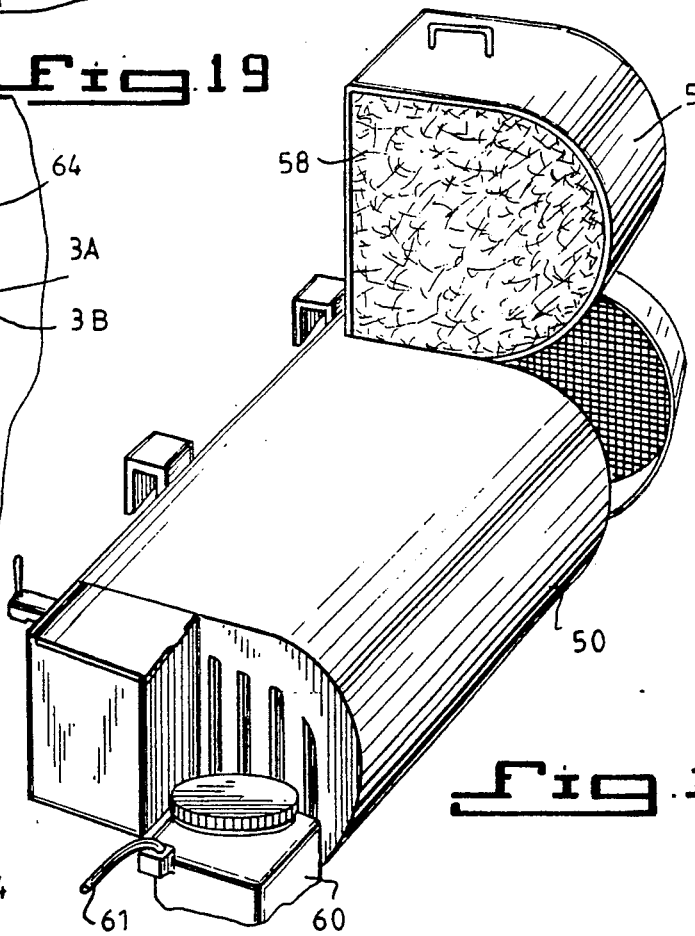
Fig. 18
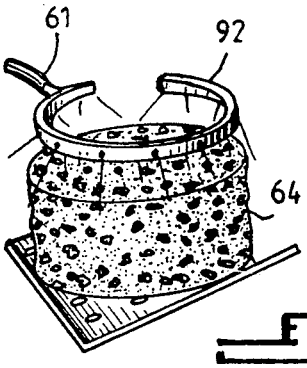
Fig. 20

ODOR REDUCTION TOILET APPARATUS

This application is a continuation in part of application Ser. No. 07/494,437, filed on Apr. 19, 1990, now abandoned.

BACKGROUND OF THE INVENTION

1. Field of the Invention

The present invention relates to an odor reduction toilet apparatus for which is particularly usable in reducing air and water generated odors from liquid waste and solid waste. These odors are reduced by incrementally introducing deodorant substances into the water during a toilet flush, as well as by moving odor filled air away from the toilet bowl in an isolated and efficient manner through the overflow drain for dispersal.

In the present invention a quantity of deodorant substance is provided with an incremental dispenser to permit the flushing of incremental quantities of deodorant into the water of the toilet bowl during a flush of waste from the tank. To release the retained air odors, a fan ventilator is activated to incrementally remove foul air from the toilet bowl by propelling the air outward up through the overflow drain before a flush cycle. The evacuated air is either propelled out of the room or is propelled against a deodorant filter within the toilet tank.

2. Description of Prior Art

Various inventions have been provided for toilet systems which reduce the flow of odor filled air through ventilating systems. There are known to be complicated ventilating devices which evacuate malodorous air from toilet tanks by the use of fans, etc. However, these systems are generally complicated and require extensive modifications. These prior art devices do not fulfill a long felt need for a toilet system which not only evacuates malodorous air, but also which cleanses the soil filled water and air by incremental discharge and release of small quantities of waterborne and airborne deodorant particles into the water and air in the toilet bowl in the toilet so as to purify and deodorize the water and air therein. This long need is derived from the fact that conventional toilets do not have a means for deodorizing the water and air in the toilet bowl.

The prior art systems will vary the amount of evacuated air but only by complicated air fan mechanisms to blow the malodorous air from solid or liquid waste in the bowl.

SUMMARY OF THE INVENTION

Accordingly, it is an object of the present invention to provide an odor reducing toilet which avoids the disadvantages of the prior art.

More particularly, it is an object of the present invention to provide an odor reducing toilet which incrementally allows small quantities of deodorant particles to reduce odor from liquid and solid wastes within the toilet bowl.

It is a further object of the invention to separately introduce deodorant particles into the air and water in the toilet bowl respectively.

In keeping with these objects and with others which will become apparent hereinafter, one feature of the invention resides, briefly stated, in an odor reducing toilet which includes a system for the incremental discharge, release and circulation of small quantities of deodorant within the water in the toilet bowl, as well as an accessory means to discharge, release and circulate air from the toilet bowl against deodorant particles within the air of the tank, or to an external room exit.

To accomplish these objects, the deodorant within the water is discharged and released only upon the flush cycle of the waste from the toilet. During the flush cycle, a small quantity of water is isolated and directed through the tank refill tubing conduit into a dispensing chamber having releasable quantities of a waterborne deodorant substance, and the water propels an incremental quantity of the waterborne substance out of the dispensing chamber into the water in the toilet bowl, solely during the flush. Upon completion of the flush cycle, the discharge of the deodorant substance ceases. The waterborne deodorant substance is situated within the chamber elevated above an air space to permit drying of the deodorant substance between use. The deodorant substance, such as a blue cleaner can clean toilet bowl water and give blue color to the water, and also provides a good odor and antirust properties. This system works efficiently and lasts longer than any others in the market because the blue cleaner is dispensed with a little quantity of its chemical components only when one flushes the toilet.

Furthermore, a second accessory airborne deodorant chamber may be provided to incrementally discharge, release and circulate malodorous toilet bowl air up through the overflow drain pipe and through a cache of airborne deodorant particles. The fan of the dispensing chamber forces and propels the air from the bowl against airborne deodorant particles from a particalized cache of the airborne deodorant substance into the toilet tank. For example, the invention may have a small box, installed on the overflow drain into the toilet tank, which can extract or vacuum out bad odors from the toilet bowl, making bathrooms free of bad odors by means of the scented filter. The invention can be used in any bathroom that has a system of a conventional toilet as shown in the drawings attached, and can be easily installed. While the propulsion of the toilet bowl air against the deodorant particles can be manually controlled by a simple switch, the process of releasing airborne particles can be incrementalized by a pressure activated switch which is activated when the body weight of a user is placed on the seat structure atop the rim of the toilet. When the body weight of the user is removed from the seat, the switch activating the fan and effectuating the discharge and release of toilet bowl air against the deodorant particles, no more deodorant will evacuate.

A further ventilating system is provided to evacuate residual odor from the air in the toilet bowl out of the room to an exterior outlet.

In order to allow the complete evacuation of odors for solid waste, the outlet is disposed away from the tank by an extension conduit connected to the overflow drain pipe so as to allow complete evacuation of the malodorous air from the toilet bowl when the drain pipe is not serving to introduce water from the refill tube into the toilet bowl.

The novel features of the present invention are set forth in the appended claims. The invention itself, however, will be best understood from the following description of the preferred embodiment which is accompanied in the following drawings.

BRIEF DESCRIPTION OF THE DRAWINGS

FIG. 2 is a side view of the device as shown in FIG. 1.

FIGS. 3, 4, 5 and 6 are close up views of use of body weight activated pressure portion of the device.

FIG. 11 is a rear view of the device as shown in FIG. 10.

FIG. 12 is a top view of the device as shown in FIG. 10.

FIG. 16 is a close up front view showing an attachment of the waterborne deodorizing dispenser.

FIG. 17 is an enlarged view of an attachment clip connecting the waterborne deodorizing dispenser to the airborne deodorizing dispenser.

FIG. 18 is a perspective view of the device as shown in FIG. 16 with a removable filter.

FIG. 19 is an alternate use of the waterborne deodorizing dispenser without the airborne venting system.

FIG. 20 is an enlarged perspective view showing the cylindrical sprinkler arrangement device to equally disperse water flow from the refill tube over the deodorant cache.

DESCRIPTION OF THE PREFERRED EMBODIMENT

Figure 1:
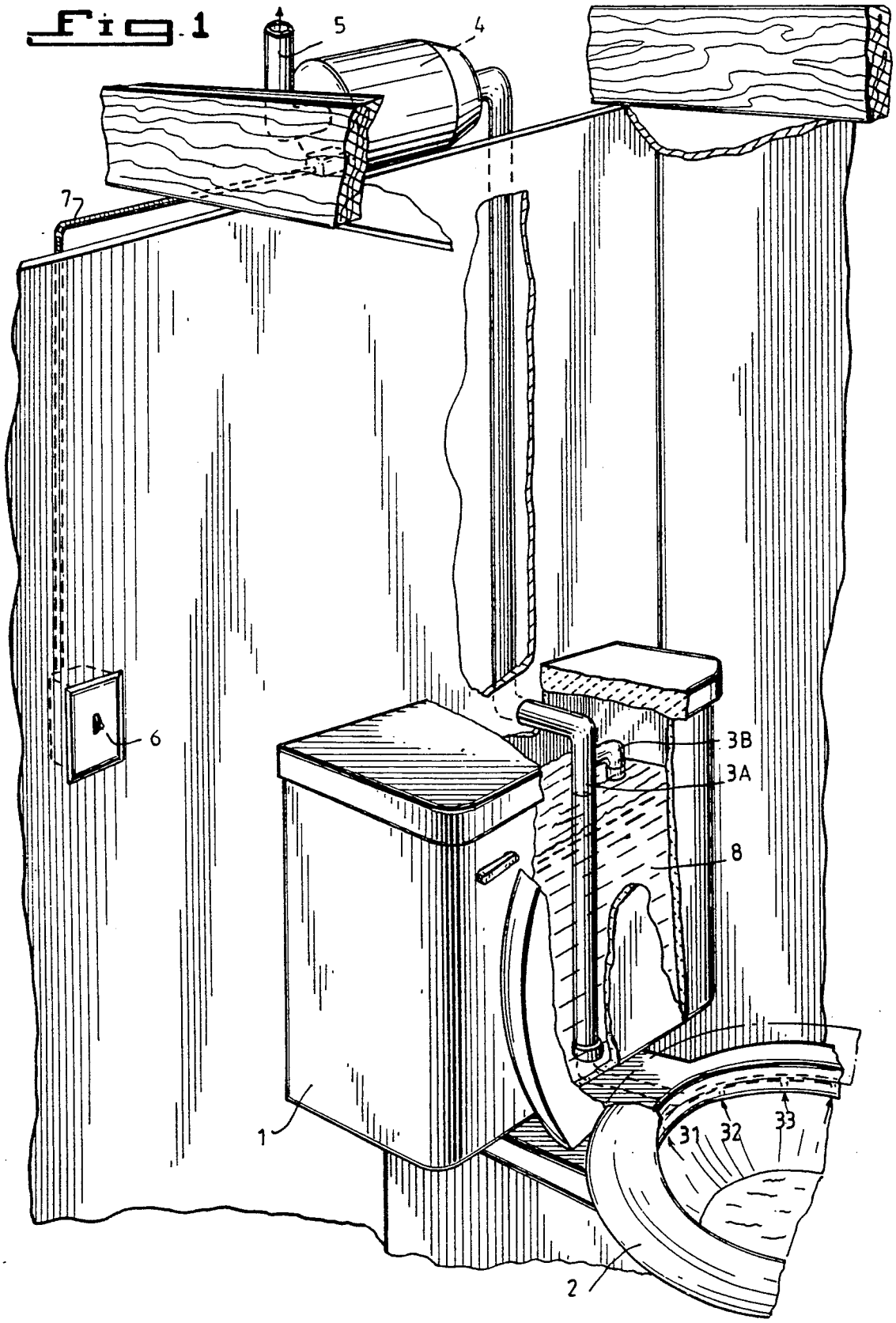
FIG. 1 is a perspective view of a built in venting system of the device.

As shown in FIG. 1 there is provided a toilet with a tank 1, a seat 2, and a toilet bowl 3 having a plurality of air holes 31, 32, 33 etc. for evacuating malodorous toilet bowl air through outlet drain pipe 3A to exhaust the air from the air in the toilet bowl. The air is propelled through the exhaust outlet drain pipe 3A to a fan apparatus 4 and an outlet exit pipe 5. The fan 4 is operated manually by switch 6 connected by wire conduit 7 to fan 4. In order to allow the outlet drain pipe to function as a conventional overflow drain, elbow member 3B is provided with access to water 8 within tank 1. Elbow member 3B is necessary, because the overflow drain pipe 3A is isolated from water 8 within tank 1 by virtue of its connection to fan 4 for exhausting outward of air from toilet bowl 3. FIG. 2 is a side view of the device as provided in FIG. 1 showing tank 1, seat 2, bowl 3, and outlet drain pipe 3A.

As shown in FIG. 3, an alternate embodiment is provided for automatic actuation of the ventilation fan 4 when the seat is occupied by a user's body weight. When the user seats upon the seat 2, pressure switch 11 is activated by the body weight of the user causing contact between connectors 12 and 13 thereby closing an electrical circuit to activate the fan 4 to evacuate malodorous odors from the toilet bowl and outward through conventional holes 31, 32, 33, etc. to overflow drain pipe 3A, fan 4 and outlet exit pipe 5.

Figure 7:
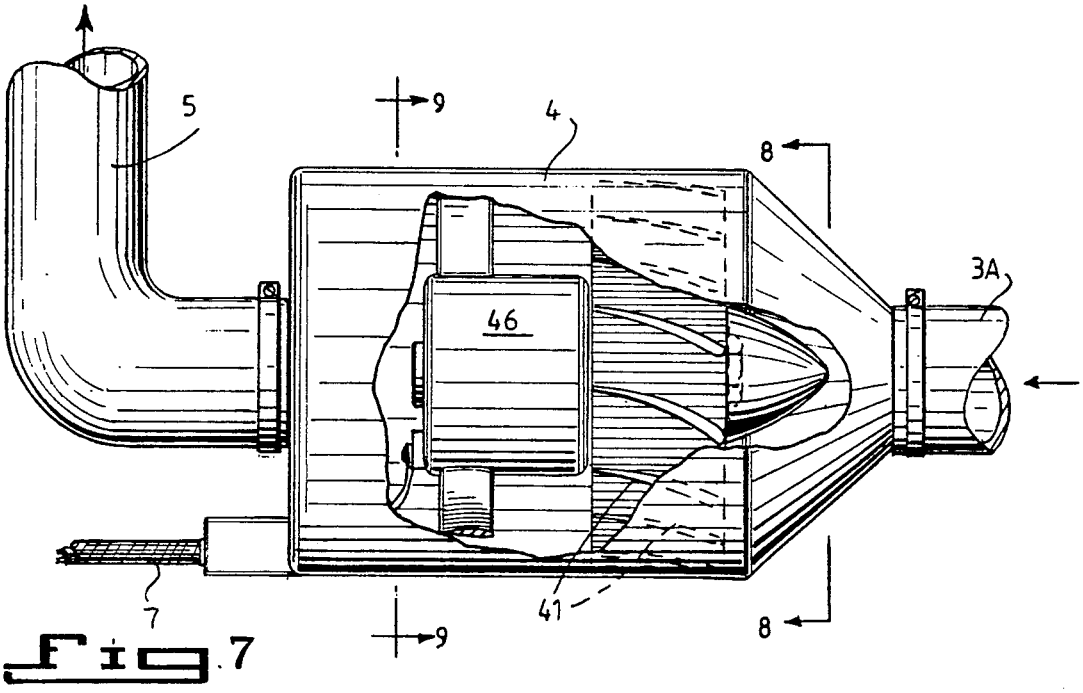
FIGS. 7, 8 and 9 are close up views of the ventilating exhaust portion of the device.
Figure 8:
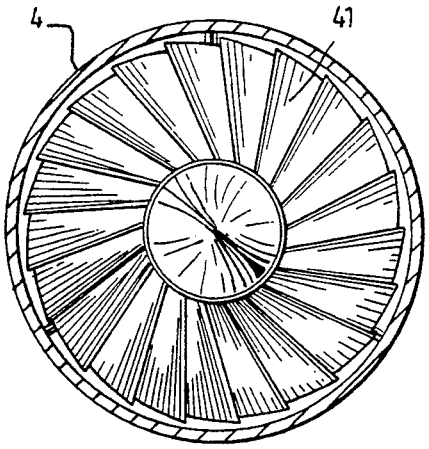
Figure 9:
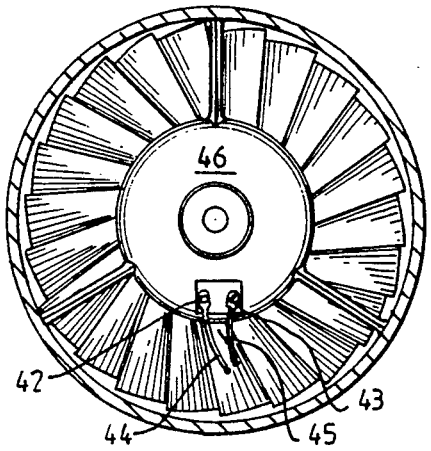

FIGS. 7, 8 and 9 show close up views of the ventilating exhaust portion of the device as shown in FIG. 1. The fan 4 contains a motor 46 activated by electricity from wire conduit 7. First outlet pipe 3A brings in air which is forced by fan 41 through fan housing 4 to outlet exit pipe 5. Fan 41 is activated by motor 46 which is connected by electrical contacts 42 and 43 to wires 44 and 45 within wire conduit 7.

Figure 10:
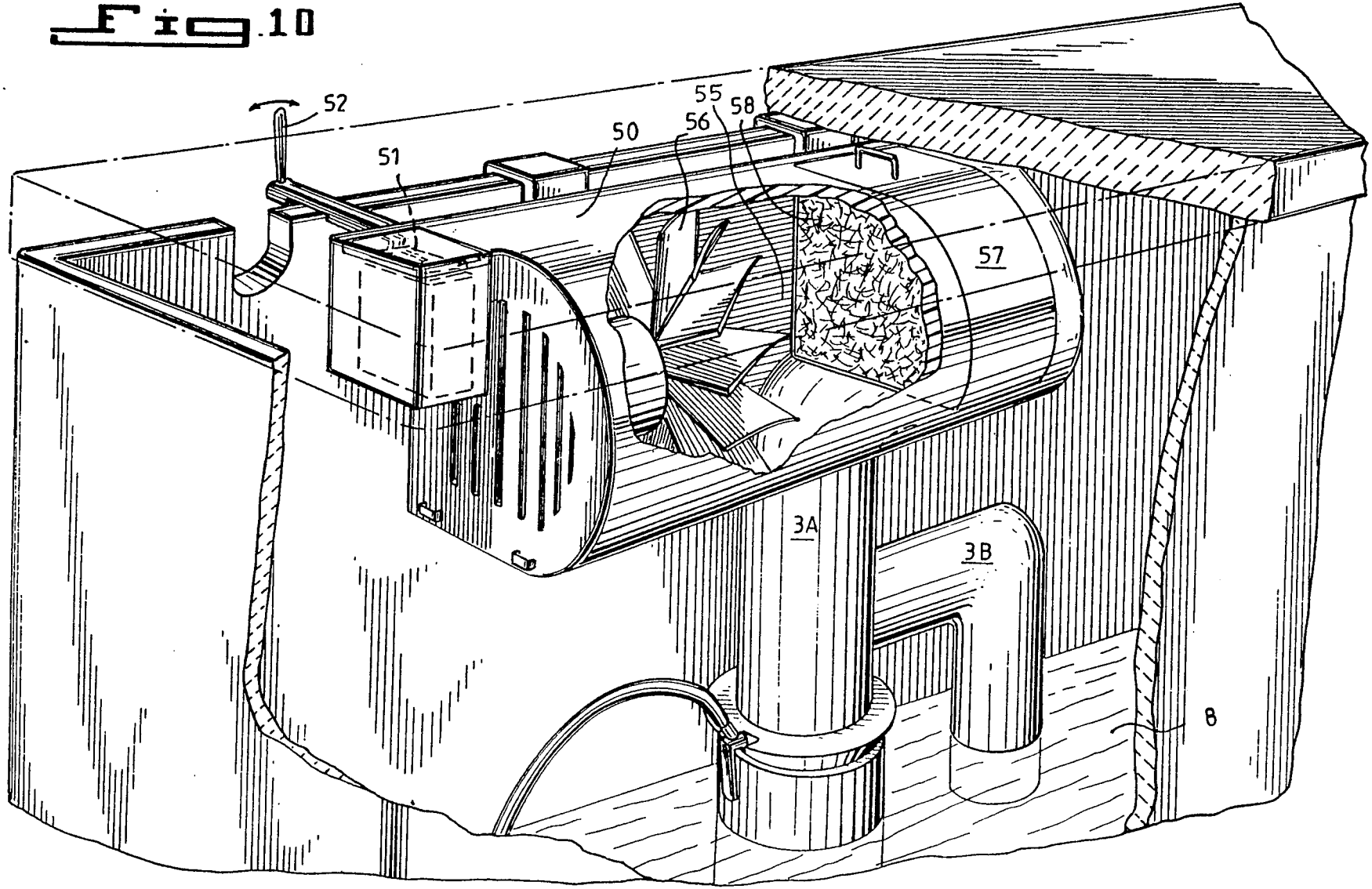
FIG. 10 is a perspective view of the airborne deodorant releasing chamber.

FIG. 10 is a perspective view of the airborne deodorant releasing chamber of the device. A battery operated switch 51 with a switch handle 52 is provided to activate fan 56 within the chamber. Foul malodorous air from toilet bowl 3 is directed through overflow drain pipe 3A to the dispensing chamber 50. The malodorous air is forced by means of the fan 56 through the air chamber 55 and then is propelled into contact with deodorant filter cache 58 made up of a cake-type filter aggregation of airborne deodorant particles, a small increment of which are discharged, released and circulated with the malodorous air from the toilet bowl 3. Fan 56 may be placed either to the left or right of the top of overflow drain pipe 3A.

As stated before in the alternative embodiment, a similar user activated body weight switch as shown in FIGS. 3, 4, 5 and 6, may be employed in lieu of manual switch handle 51 to activate airborne particle dispensing chamber 50 as stated before.

As illustrated in FIGS. 11 and 12 there is shown a rear view showing the internally mounted fan unit 50 within tank 1. This unit 50 is also shown in a cutaway top view as shown in FIG. 12.

Figure 13:
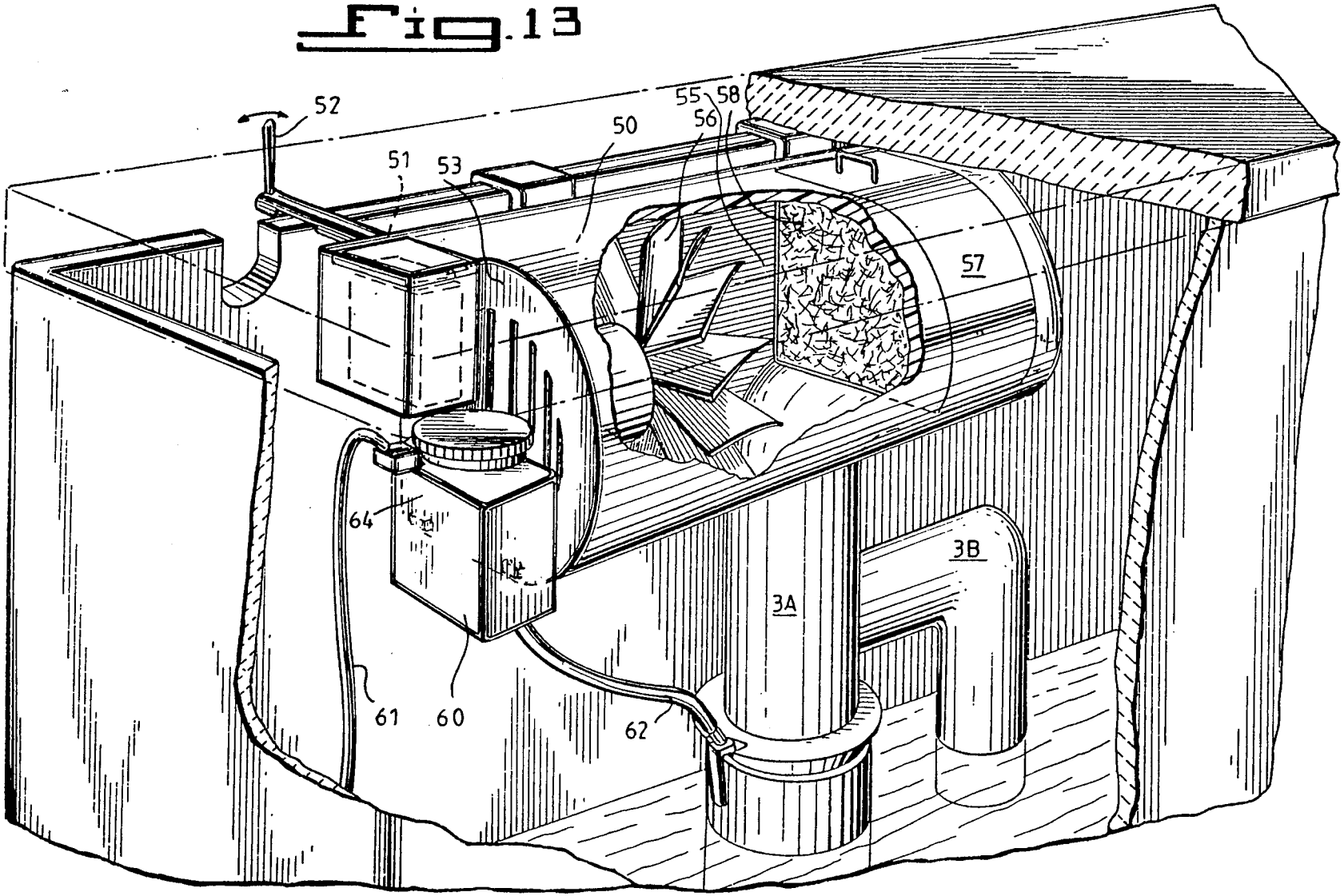
FIG. 13 is a perspective view of the incremental waterborne deodorant disposing chamber in conjunction with the airborne deodorant chamber as shown in FIG. 10.

As shown in FIG. 13 air dispensing chamber 50 may also be provided in conjunction with waterborne particle dispensing chamber 60 for incrementally discharging, releasing and circulating incremental amounts of waterborne deodorant particles throughout the water in toilet bowl 3 during the flush cycle of the toilet use. The airborne particle dispensing chamber 50 is operated as stated aforesaid. The waterborne particle dispensing chamber is operated wherein a water directing conduit 61, conventionally a tank refill tube, is provided for directing an incremental amount of water during the flush cycle into waterborne particle dispensing chamber 60 so as to come in contact with waterborne particle deodorant cache 64 to incrementally discharge, release and circulate a small quantity of said waterborne particles through overflow drain pipe 3A and into toilet bowl 3 by means of an extension tube 62 from dispensing chamber 60 into overflow drain pipe 3A and thereafter through air holes 31, 32, 33, etc. into the water in toilet bowl 3.

Figures 14, 15:
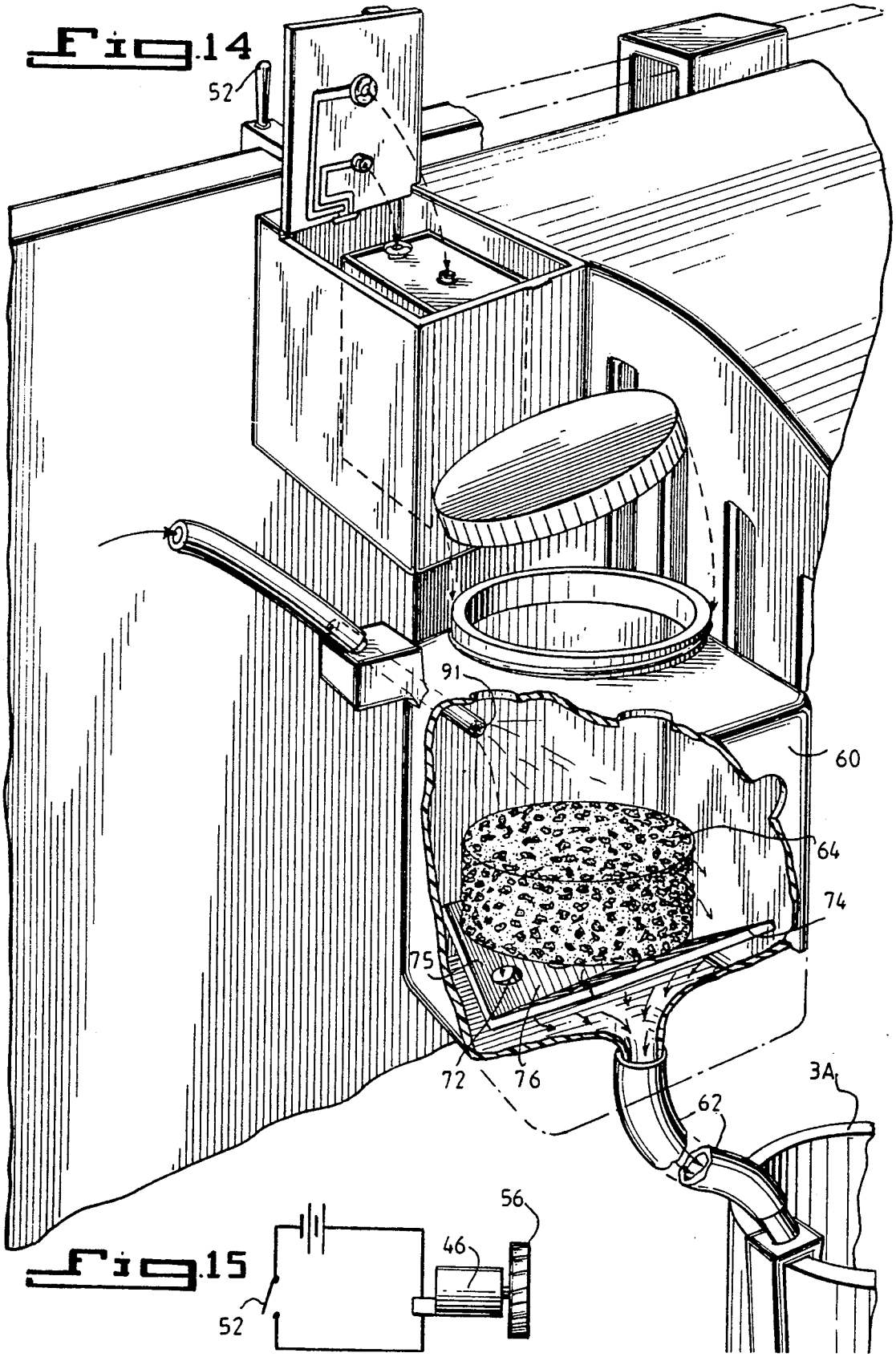
FIG. 14 is an alternate embodiment of the waterborne dispensing chamber in use.
FIG. 15 is an electrical schematic of an alternative manually operated switch for the device as shown in FIG. 14.

As illustrated in FIG. 14 there is shown the waterborne dispensing chamber which may be provided without the exhaust fan features as described previously herein. Chamber 60 has disk shaped cake deodorant cache 64 which is supported over V-shaped member 74 so that the incremental waterborne deodorant particles are related downward through the slanted sides 75 and 76 of V-shaped support member 74 into drain pipe 3A and thereafter into the water of the toilet bowl. By supporting the deodorant cache in this manner, an air space is provided underneath the cache of deodorant material 64 to allow the deodorant cache to dry in between use. In order to evenly distribute water pressure from water refill tube 61 against deodorant cache 64, there is provided a water diffuser, such as mist nozzle 91 for even discharge of water onto and through deodorant cache 64.

FIG. 15 is an electrical schematic of a manually operated switch for the fan portions of the device.

FIGS. 16 and 17 are close up front views showing how waterborne dispensing chamber 60 may be attached to airborne deodorant particle dispensing chamber 50 by means of hook and eye member 80 wherein hook portion 81 is insertable within eye portion 82 for attachment of waterborne deodorant chamber 60 to airborne deodorant chamber 50.

As shown in FIG. 18 airborne deodorant particle dispensing chamber 50 is provided with a lever operated filter dispenser 57 for housing deodorant filter cache 58. Because filter housing member 57 is rotatable upward, filter 58 can be easily removed.

FIG. 19 is an alternate use of the waterborne particle dispensing chamber 60 wherein the waterborne dispensing chamber 60 is directly mounted upon the standard drain outlet pipe 3A of the toilet, without the necessity of secondary water outlet pipe 62 connecting chamber 60 to overflow drain pipe 3A. The alternate mounting of chamber 60 directly over overflow drain pipe 3A is accomplished when there is no use of the overflow drain pipe 3A for air exhaust of air from the toilet bowl.

As shown in FIG. 20 there is illustrated a close up perspective view of a cylindrical sprinkler nozzle 92, arrangement to equally disperse the water from refill tube 61 evenly onto waterborne particle deodorant cache 64 and thereafter throughout overflow drain pipe 3A to the water within toilet bowl 3. It may be used as a water diffuser in lieu of mist element 91. Circular sprinkler nozzle portion 92 is attached to water directing inlet conduit 61. Because of the circular arrangement of the nozzle, the water pressure from refill tube 61 is evenly dispersed throughout the deodorant particle cache 64 for dispensing the waterborne particles in even directions throughout the cache 64. These particles are distributed in an equitable geometric pattern through the filter cache 64 into the water of the toilet bowl 3.

Various plumbing fittings may be provided for the present application of the invention. What is important is that malodorous air and water in the toilet bowl be incrementally purified as aforesaid while the toilet itself is in use.

While the features of the invention may be apparent from the foregoing specification and drawings, other modifications may be made without departing from the scope of the invention, as described in the foregoing claims.

What is desired to be protected by Letters Patent is set forth in the appended claims.

What is claimed is:

1. An odor reducing device for a toilet bowl and tank, said bowl including a toilet seat, said tank being in communication with said bowl through an overflow pipe, said tank including a bowl refill conduit, said odor reduction device comprising in combination:

a first housing adapted to be mounted within said tank, said first housing having an aggregate of airborne deodorant particles housed within a first dispensing chamber, said first dispensing chamber adapted to be in communication with said overflow pipe;

said first housing including means for forcing malodorous air from said toilet bowl through said first dispensing chamber; said means for forcing malodorous air including an exhaust chamber within said first housing having a fan, therein and electric source for activating said fan, said exhaust chamber further having an air intake portion in communication with said first dispensing chamber and an outlet communicating exteriorly of said first housing, said fan being capable of directing malodorous air from within the toilet bowl into the interior of said first dispensing chamber for directing an incremental portion of said deodorant particles exteriorly of said first housing and exiting out of said air of said tank;

a second housing removably mounted to said first housing, said second housing defining a second dispensing chamber having an aggregate of waterborne deodorant particles therein, an inlet conduit in communication with said second dispensing chamber, said inlet conduit adapted to be in communication with said bowl refill conduit, said inlet conduit further having a nozzle member for directing a flow of water from said toilet bowl refill conduit during a flush cycle to said chamber, said water being directed into said second dispensing chamber to incrementally release and irrigate a portion of said waterborne particles into the water of said toilet bowl for purifying and deodorizing said water within said toilet bowl.

2. The device as in claim 1 further comprising a manual switch connected to operate said electric source.

3. The device as in claim 1 further comprising a pressure activated switch connected to operate said electric source wherein said switch is activated upon the impression of user body weight upon the toilet seat and deactivated upon the release of user pressure body weight from said seat.

4. The device of claim 1, further comprising means to isolate said aggregate of waterborne particles from exposure to water during inactive periods between intermittent uses of said toilet, said means to isolate including said waterborne aggregate being elevated within said second housing at a vertical level above a bottom wall of said second housing.

5. The device as in claim 4, wherein said means to isolate further comprises a V-shaped filter support member for said waterborne aggregate so as to elevate the waterborne aggregate above said bottom wall for providing an air space under said waterborne aggregate for drying out of said waterborne aggregate after said incremental portion of said waterborne deodorant particles have been released into said water of said toilet bowl.

6. The device as in claim 4, wherein said nozzle member of said inlet conduit comprises a circular cylindrical head nozzle.

* * * * *